United States Patent [19]

Nyborg

[11] 4,079,669

[45] Mar. 21, 1978

[54] ARTICLE CONTROLLED BAG PRINTING MACHINE

[76] Inventor: Ralph A. Nyborg, 641 N. Main St., Naperville, Ill. 60540

[21] Appl. No.: 654,978

[22] Filed: Feb. 3, 1976

Related U.S. Application Data

[63] Continuation of Ser. No. 486,385, Jul. 9, 1974, abandoned.

[51] Int. Cl.[2] ..... B41F 17/26

[52] U.S. Cl. ..... 101/37; 101/245; 101/DIG. 3; 214/1 BD; 214/147 T; 271/246; 271/248; 271/268

[58] Field of Search ..... 101/35–37, 101/232, 233, 234, 235, 236, 237, 238, 239, 240, 241, 242, 243, 247, DIG. 3; 214/1 BD, 147 T; 271/268, 277, 246, 248

[56] References Cited

U.S. PATENT DOCUMENTS

| | | | |
|---|---|---|---|
| 1,019,296 | 3/1912 | Beauregard | 101/237 |
| 2,120,247 | 6/1938 | Funk et al. | 101/235 X |
| 2,380,331 | 7/1945 | Ryan et al. | 101/233 |
| 2,470,075 | 5/1949 | Robbins | 101/36 |
| 2,641,998 | 6/1953 | Donald | 101/235 |
| 2,729,136 | 1/1956 | Feick et al. | 271/248 X |
| 2,761,545 | 9/1956 | Hoagland | 101/37 X |
| 2,767,651 | 10/1956 | Willsea | 101/232 |
| 2,934,009 | 4/1960 | Bach et al. | 101/235 |
| 2,939,389 | 6/1960 | Tremba | 101/147 X |
| 3,037,447 | 6/1962 | Gonzales et al. | 101/235 X |
| 3,039,385 | 6/1962 | Siegel | 101/235 X |
| 3,111,896 | 11/1963 | Hovekamp et al. | 101/37 |
| 3,131,631 | 5/1964 | Haskin, Jr. | 101/247 X |
| 3,146,699 | 9/1964 | Ayers | 101/247 X |
| 3,217,639 | 11/1965 | Kelly | 101/233 |
| 3,354,942 | 11/1967 | Todd et al. | 214/1 BD X |
| 3,358,851 | 12/1967 | Ashton | 214/147 T X |
| 3,631,797 | 1/1972 | Johnston et al. | 101/93.48 |
| 3,716,228 | 2/1973 | Bottcher | 271/246 |
| 3,822,644 | 7/1974 | Gazzola et al. | 101/142 |

*Primary Examiner*—Clifford D. Crowder
*Attorney, Agent, or Firm*—Edward D. Gilhooly

[57] ABSTRACT

A printing machine for use in printing on an end portion of a bag or an article and the like comprises a printing roller, a back-up wheel segment, an arm journalling the wheel segment for adjustable movement toward and away from the printing roller, an elongated stop plate for guiding an article to be printed upon between the printing roller and the wheel segment, a piston-cylinder assembly actuable upon feeding the article toward the wheel segment and the printing roller to carry the wheel segment into contact with the article and the article into contact with the printing roller, and a drive common to the printing roller and the wheel segment for rotating them in unison. The drive is formed of an endless drive element operably connected to the printing roller and the back-up wheel segment.

8 Claims, 12 Drawing Figures

ARTICLE CONTROLLED BAG PRINTING MACHINE

This is a continuation of application Ser. No. 486,385, filed July 9, 1974, now abandoned.

BACKGROUND OF THE INVENTION

The invention relates generally to improvements in printing apparatus and more particularly it is concerned with apparatus for printing on the end portion of a bag or other article and wherein the article may be fed laterally into the front side of the apparatus or longitudinally thereof, and is discharged therefrom in a longitudinal direction and delivered to associtated apparatus or to a stack. Because of the compactness and resulting small size, the apparatus is particularly useful in crowded areas and further is such that bags or other articles can be fed thereinto manually without endangering the operator's hands. The apparatus also includes means to insure clear printing irrespective of the texture, thickness or material of the bag or like article and further has means to automatically drive the printing mechanism when a bag is inserted thereinto.

SUMMARY OF THE INVENTION

It is therefore an object of the invention to provide printing apparatus of the character referred to.

Another object is to provide novel means to control the feed of articles to the printing roller of the apparatus.

Another object is to provide novel means to discharge printed articles in a longitudinal direction from the apparatus.

Another object is to provide novel means to imprint clearly upon a preselected surface of an article irrespective of it's surface texture, material or size.

Another object is to provide, in an apparatus of the character referred to, novel means to control the depth to which an article is fed to the printing roller so as to locate accurately the location of the imprint placed thereon.

Another object is to provide novel means to center an article fed to the printing roller, irrespective of its width.

Another object is to provide novel means to engage a printed article and carry it away from the printing apparatus.

Another object is to provide novel means to control operation of the printing apparatus in response to the input of an article to be printed upon.

Another object is to provide a compact printing apparatus which is not difficult or expensive to manufacture and maintain serviceable, and which is very efficient in use.

BRIEF DESCRIPTION OF THE DRAWINGS

These and other objects and advantages of the invention will become apparent with reference to the following description and accompanying drawings wherein.

DETAILED DESCRIPTION OF THE PREFERRED EMBODIMENTS

Figure 1:
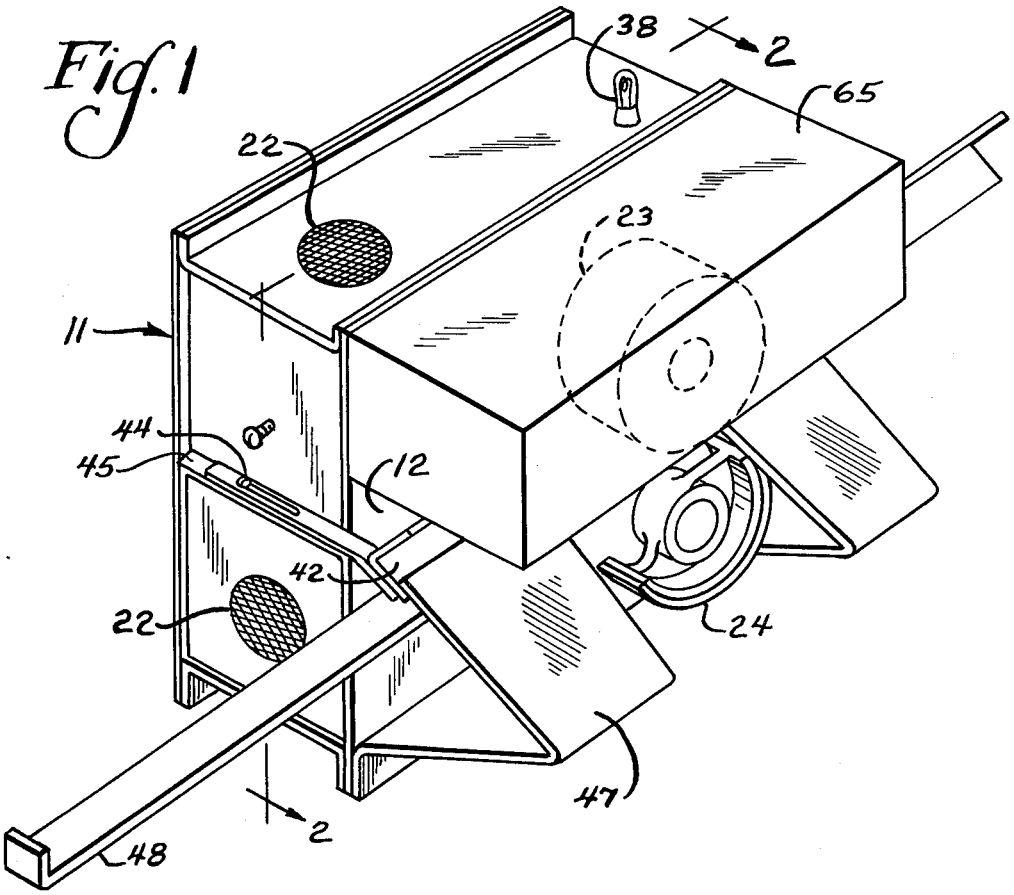
FIG. 1 is a perspective view of one embodiment of the printing apparatus.

Referring to the embodiment of the invention, as shown in FIGS. 1 through 4 of the accompanying drawings, the apparatus includes, generally, a housing 11 having a front wall 12 upon which the printing and guide means is mounted. Projecting through the front wall are three shafts, 13, 14 and 15. These shafts carry sprockets 16, 17 and 18 respectively, about which an endless drive chain 19 is arranged to operably connect said shafts with a motor 21, all arranged within the housing 11. Preferably, the housing has one or more vents 22 to aid circulation of cooling air through the housing.

Figure 5:
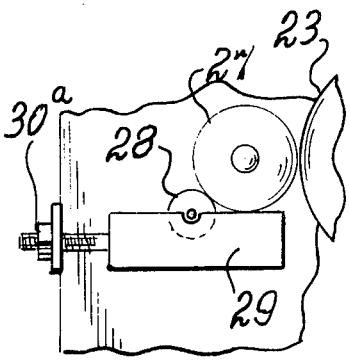
FIG. 5 is a detail of the ink feed reservoir and rollers.

The shafts 13 and 15 are in vertical alignment and the shaft 13 carries firmly thereon a printing roller 23 whereas the shaft 15 carries firmly thereon a wheel segment 24 having a diameter equal to the diameter of the printing roller 23. As shown, the shaft 15 is journalled in an arm 25 that is pivotally mounted in the housing, as at 26. In operation, the members 23 and 24 rotate at a uniform rate of speed. The projecting end of shaft 14 carries firmly thereon an ink transfer roller 27 which has a free rolling ink roller 28 in surface contact therewith. An ink reservoir or pan 29 (FIG. 5) has a U-shaped bearing in which the ink roller 28 is loosely journalled. Adjustment of the reservoir and its ink roller 28 may be effected to increase or decrease the contact pressure between ink roller 28 and transfer roller 27, by means of a screw adjustment 30$^{a}$.

Figure 3:
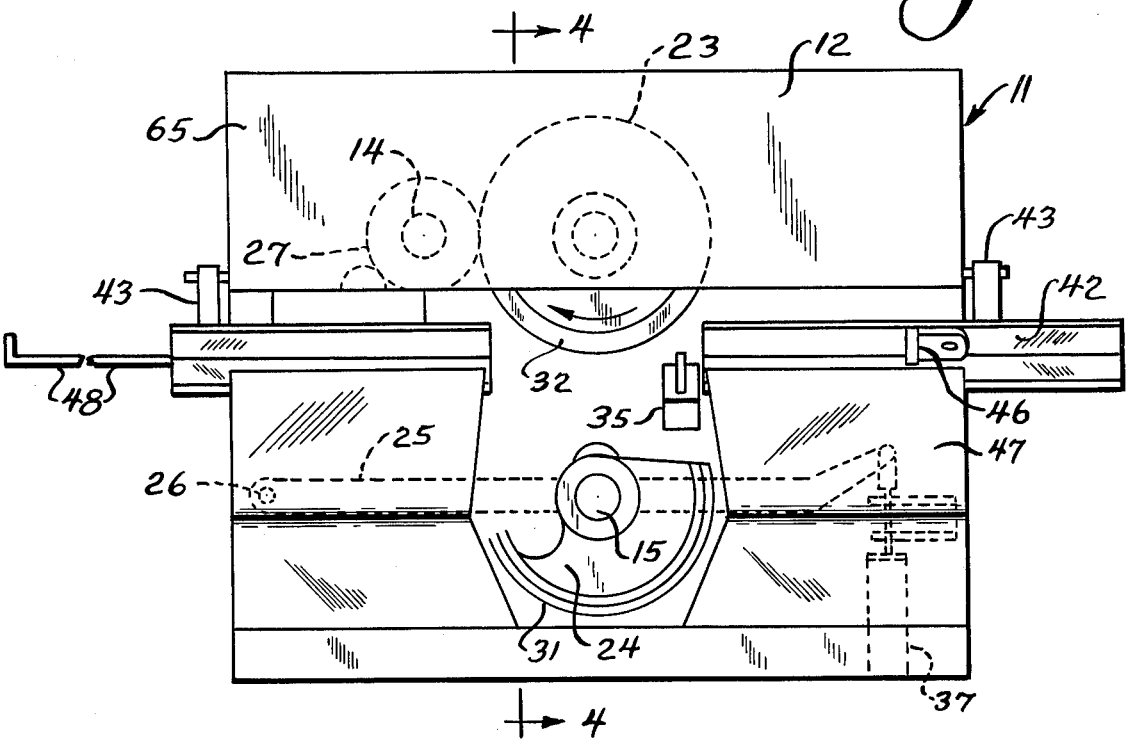
FIG. 3 is a front elevational view of the FIG. 1 apparatus.
Figure 2:
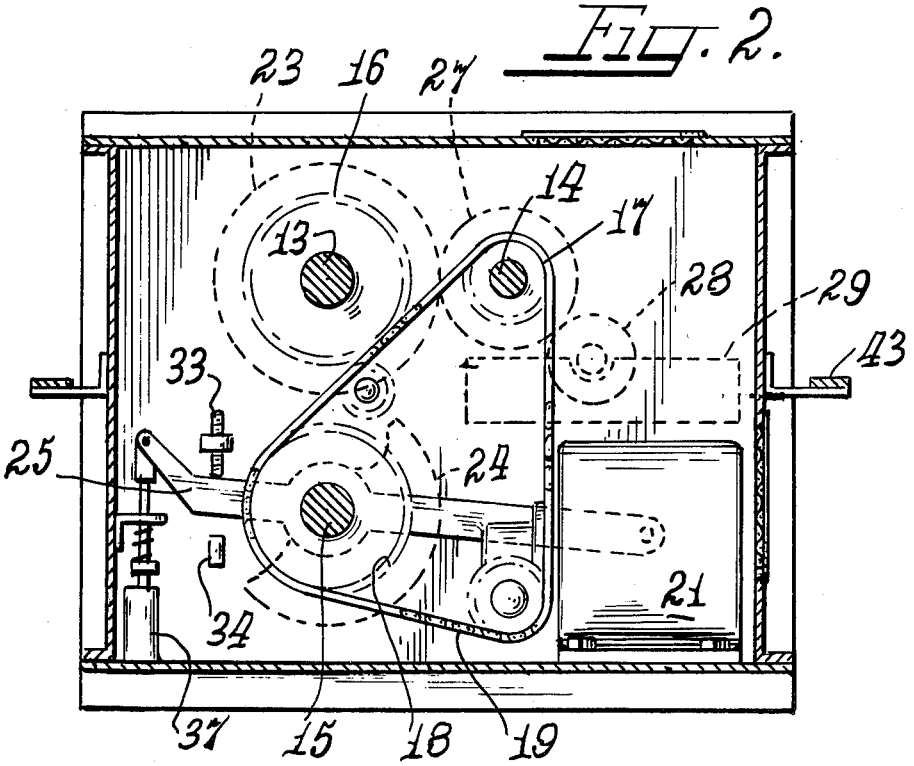
FIG. 2 is a vertical sectional view thereof, taken substantially on line 2—2 of FIG. 1.
Figure 4:
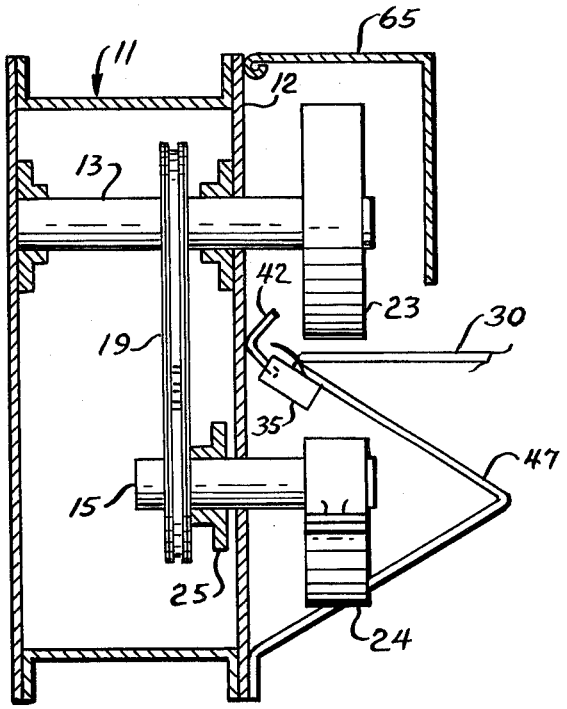
FIG. 4 is a vertical sectional view taken substantially on line 4—4 of FIG. 3.

Referring now specifically to FIG. 3, the wheel segment 24 has a surface coating 31 of soft rubber or the like and the printing surface 32 on roller 23 is also of relatively soft rubber or the like. When the two surfaces are brought together during a print operation, to be described in detail hereinafter, the print surface will bear down firmly on the article being printed, compressing the segment surface sufficiently to insure a clear imprint irrespective of the thickness of the article being printed upon or its surface texture of material.

The wheel segment can be adjusted relative to the printing roller by means of an adjustable stop 33 located above the free end of the arm 25 its downward movement being limited by a fixed stop 34.

As suggested hereinabove, the arm 25 carrying the wheel segment 24 oscillates between the two stops 33 and 34. Such oscillation is desired because in many instances of use, owing to the fast drying of ink being used, the printing roller and wheel segment must be continuously rotated. Obviously, it therefore becomes necessary when no article is present between the roller 23 and segment 24 to carry the wheel segment away from the printing roller.

Figure 9:
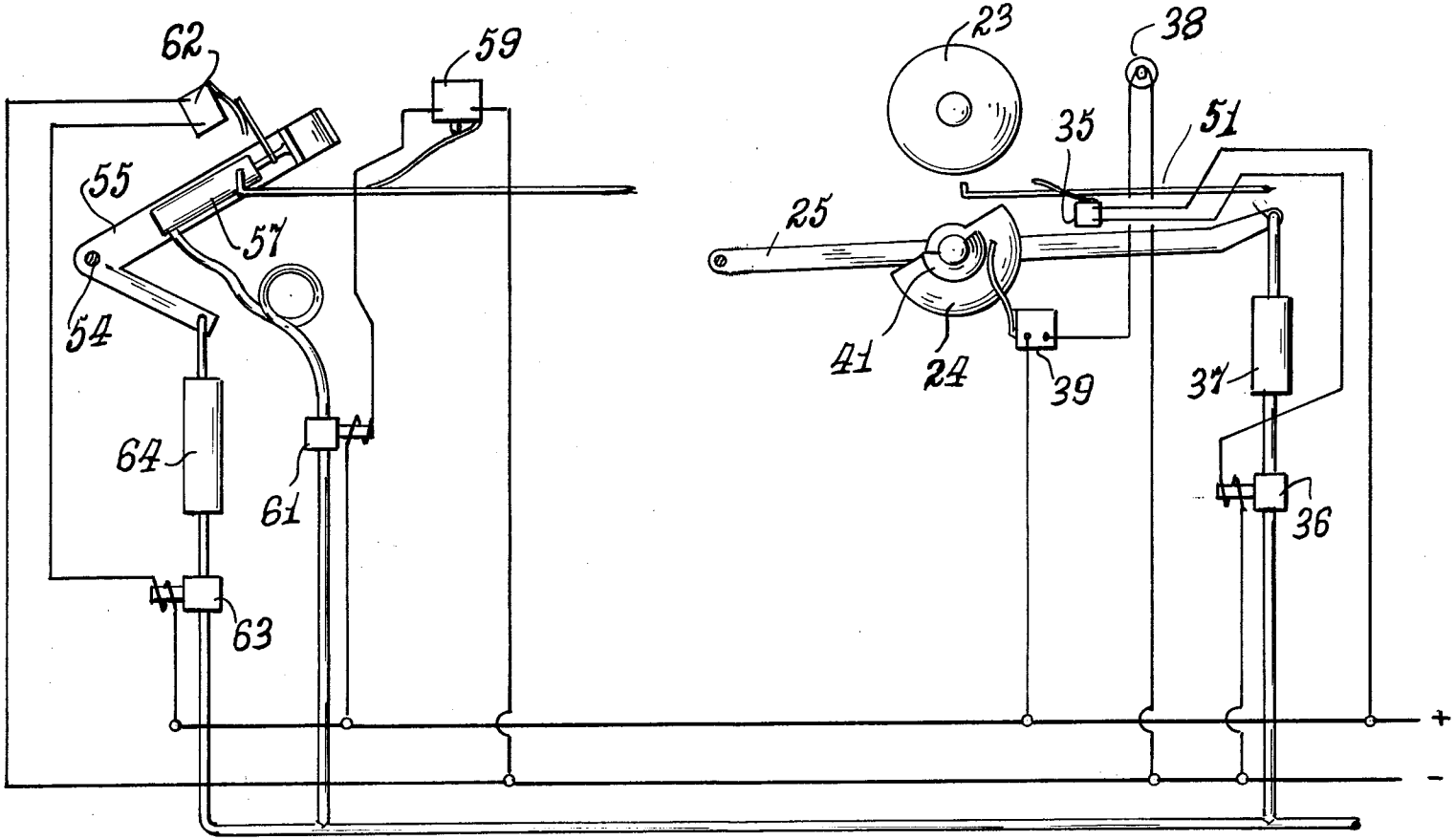
FIG. 9 is a schematic view of the air lines, valves and electrical circuit.

Now, when a bag 30 or other article is fed to the printing roller, a micro-switch 35, connected in the electrical circuit to a solenoid valve 36 (FIG. 9) is closed by contact with the article. This opens the valve 36 and causes the wheel segment to be moved upwardly through its operating piston-cylinder assembly 37 into contact with the bag or other article for carrying the article between the segment and printing roller. When the wheel segment is in its lower or ineffective position a lamp 38 is illuminated as a means to tell the operator that said wheel segment is in position to receive an article. Preferably the current to the lamp is controlled by a micro-switch 39 operated by a cam 41 on the wheel segment shaft 15.

To imprint on the end margin of a bag 30 or other flat article, such bag may be manually inserted from the front side of the apparatus beneath the printing roller 23 at a time when the large portion of the wheel segment 24 is in a lower position circumferencially (lamp lighted). To insure proper location of the bag for printing thereon, there is provided, beneath printing roller 23 a stop plate 42 which in this embodiment is in the form of a horizontally disposed V-shaped channel having its central portion suitably cut away to allow the printing roller and wheel segment to project into the channel of the V.

The stop plate 42 is adjustable toward and away from the housing preferably by means of integral arms 43 on the side walls of housing 11. This adjustment is for purposes of locating a bag end portion with respect to the printing roller to predetermine the area to be printed on. The stop plate also has, at one end (right hand as viewed in FIG. 3) a guide stop 46 adjustable by a conventional over-sized hole to determine the lateral position of the bag to further locate the printing area beneath the printing roller.

In use, the end of a bag is thrust into abuttment with the bite of stop plate 42, it being guided thereinto by an inclined guide surface 47 arranged and secured firmly to the housing front wall on either side of the wheel segment 24. With the motor 21 operating, the bag is clamped between the printing roller and the wheel segment which, rotating the unison in a counter-clockwise direction, carry the bag longitudinally along the stop plate 42 during the printing operation and discharges it onto a discharge guide 48 located to one side of the apparatus (left hand end in FIG. 3). As noted hereinabove, bags or like articles may be fed into the printer shown in FIG. 1 in a longitudinal direction by removing the lateral stop 46 and guiding the bag along the V-shaped stop plate 42.

Figure 6:
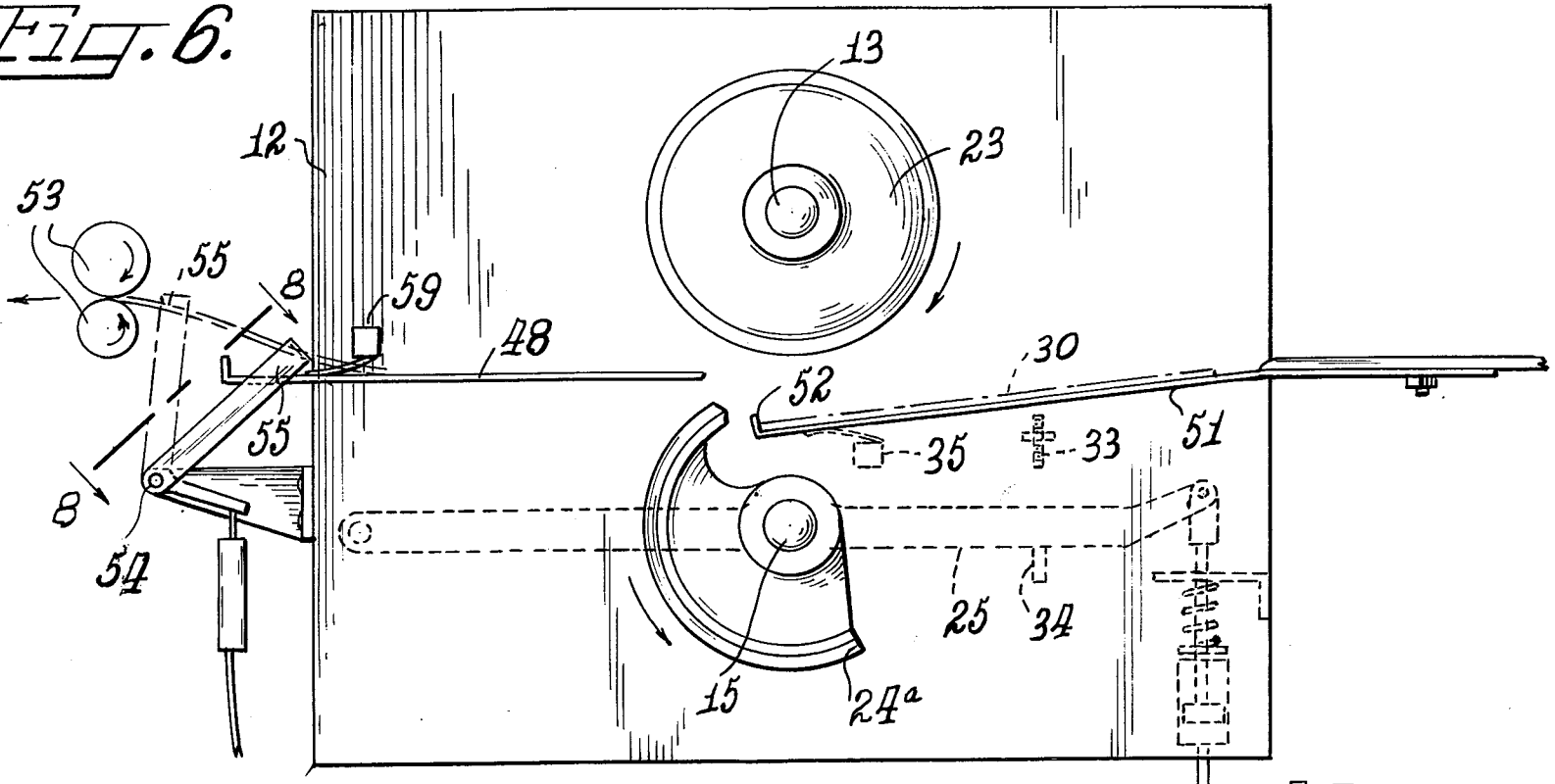
FIG. 6 is a front view of the apparatus, modified to accept longitudinal feeding of articles thereto, showing the parts in idle position.
Figure 7:
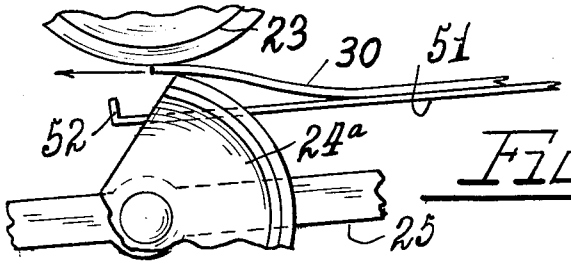
FIG. 7 is a detail view showing the printing roller and wheel segments positioned to receive an article between them.
Figure 8:
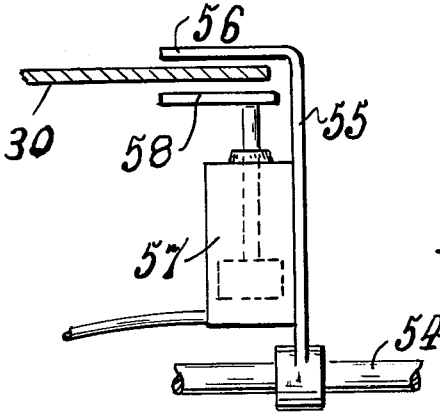
FIG. 8 is a detail of the article engaging member at the discharge end of the apparatus, taken substantially along line 8—8- of FIG. 6.

In FIGS. 6 through 8, a printer especially designed for longitudinal feeding is illustrated. Like numerals are used to identify parts corresponding to the FIGS. 1 to 4 disclosure. To this end, there is provided a pair of horizontally disposed guide strips 51 that terminate, in the region of wheel segment 24, in an upstanding lip 52 that acts as a stop to limit initial insertion of the article. When an article is laid over said guides, the wheel segment 24 is disposed in its lower ineffective position beneath it. To carry the wheel segment into its print roller engagement in the manner noted hereinbefore, the micro-switch 35 is actuated by passage of the article thereover. Now, as the wheel segment continues its counter-clockwise rotation, the lead edge **24*a* thereof will engage beneath the article (FIG. 7) and lift it up into position to be engaged between the printing roller 23 and the wheel segment to thereby cause printing of the same and its discharge in a longitudinal direction onto a discharge chute 48**.

The discharge end of the discharge chute 48 preferably is provided with automatic means to lift the printed article off the discharge guide or chute 48 and carry it upwardly for engagement with feed rollers 53 provided to deliver the article to a stack or to auxiliary equipment. To accomplish this the apparatus housing 12 carries a horizontal rotatable shaft 54 located below the discharge chute 48 to which is firmly mounted a pair of L-shaped brackets 55 (one shown), each having its horizontal leg 56 extending inwardly to overlie the margin of the discharged article. Each bracket carries a piston-cylinder assembly 57 operable to move a clamp plate 58, normally located below the article, upwardly to clamp the lead edge of the printed article between it and the related horizontal leg 56. When the article is so clamped, the shaft 54 is rotated in a counter-clockwise direction to swing the clamp into the dotted line position illustrated in FIG. 5 so as to carry the lead end of the article upwardly and forwardly for engagement between feed rollers 53.

Actuation of the clamp piston-cylinder 57 is effected by means of a normally open micro-switch 59 arranged in the path of the discharged article. Thus, when said switch is closed by the presence of an article, a solenoid valve 61 (FIG. 9) is opened to actuate the piston-cylinder assemblies 57 and move the clamp plate into clamping engagement with the article.. As soon as the clamp engages the article firmly, a micro-switch 62, carried by one L-shaped bracket 55, and disposed in the path of the clamp plate 58, is actuated by the clamp plate to open a solenoid valve 63 controlling operation of a piston-cylinder assembly 64 operable to rotate the shaft 54.

Figure 10:
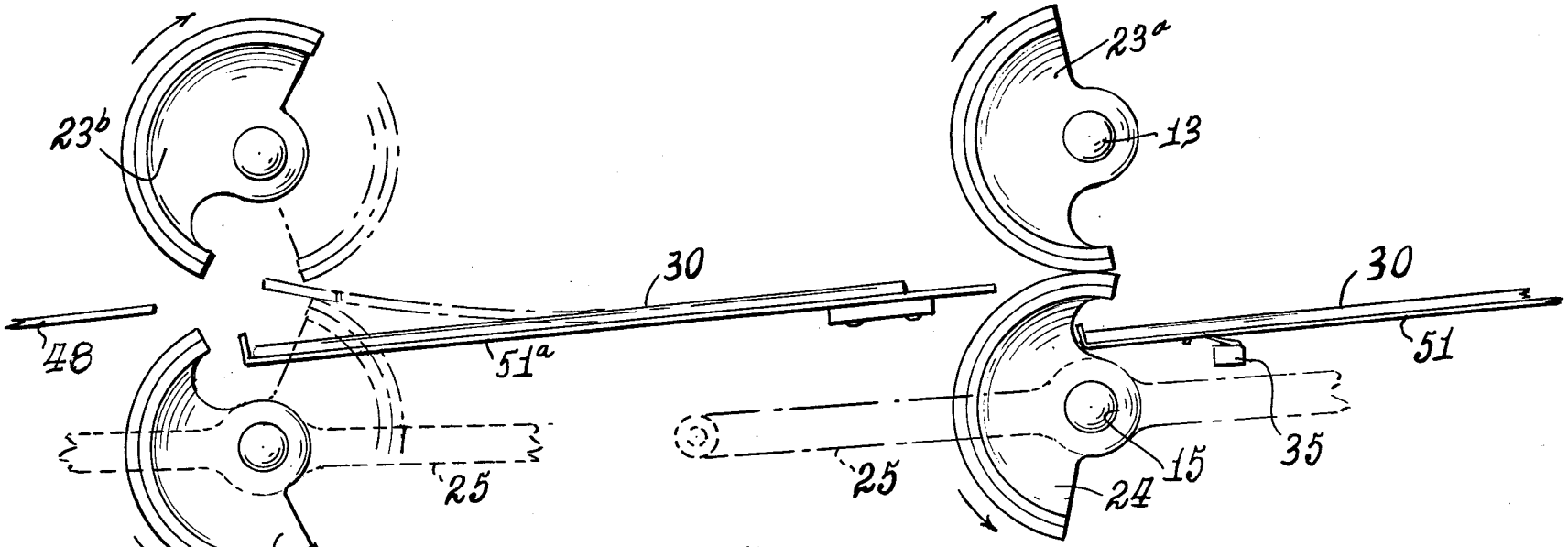
FIG. 10 is a front view similar to FIG. 6, but illustrating a second printing and back-up assembly for two-color printing.

The FIG. 10 structure is essentially like that illustrated in FIG. 6 and like numerals are used to identify corresponding parts. In this disclosure, there are two sets of printing and back-up segments spaced apart along the path of the bag fed therethough so as to sequentially print indicia on the bag. Each set can be used to print a different color.

More specifically, in this embodiment the printing wheel 23 of FIG. 6 is replaced by a printing wheel segment **23*a* suitably secured to its drive shaft 13 in position to cooperate fully with the back-up wheel segment 24. Referring to the right-hand side of the FIG. 10 illustration, the printing assembly shown is substantially like that in FIG. 6 except for the substitution of the segment 23*a* for the wheel 23 of FIG. 6. However, the discharged printed bag or paperboard is discharged onto a second set of guide strips 51*a* along which the bag or paperborad is carried to a second combination of a printing and back-up wheel segment, 23*b* and 24*b* respectively, which function in a manner like the first set so as to initially lift the bag from the guide strips 51*a*** and print it or the paperboard in the same or in a different color. Alternatively, instead of two color printing, the first set of segments could be utilized to blank out previous printing on the article and the second set of segments could then be used to print new matter over the blocked out material.

Figure 11:
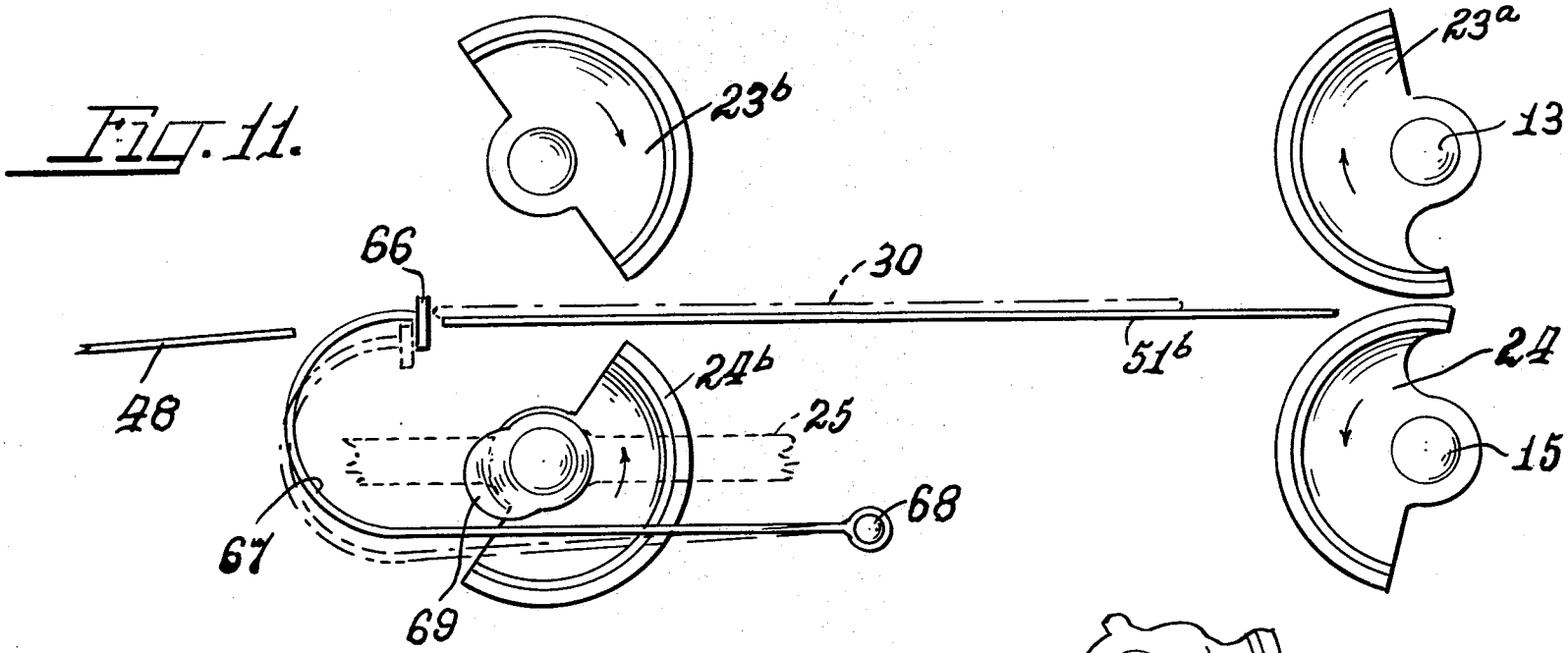
FIG. 11 is a view similar to FIG. 10, showing another printing and back-up assembly for two color printing, including a movable stop.

The FIG. 11 disclosure is quite similar to the disclosure in FIG. 10, and like numerals are used to identify corresponding parts. The guide strips 51*b* in this instance have no stop flange formed on its discharge end. Instead, a movable stop 66 is located at said end. This stop is carried on the free end of a spring arm 67 anchored at 68 for vertical movement in response to the position of a cam 69 on the shaft of segment 24*b*. Normally the stop 66 is effective to limit forward movement of the bag or paperboard 30. As the wheel segment 24*b* rotates into position for bag or paperboard engagement, the cam forces the arm 67 and its stop 66 downwardly (dotted lines) out of the path of such bag or paperboard to thereby allow it to be fed between the rotating printing segment 23*b* and back-up segment 24*b* for printing thereon.

Figure 12:
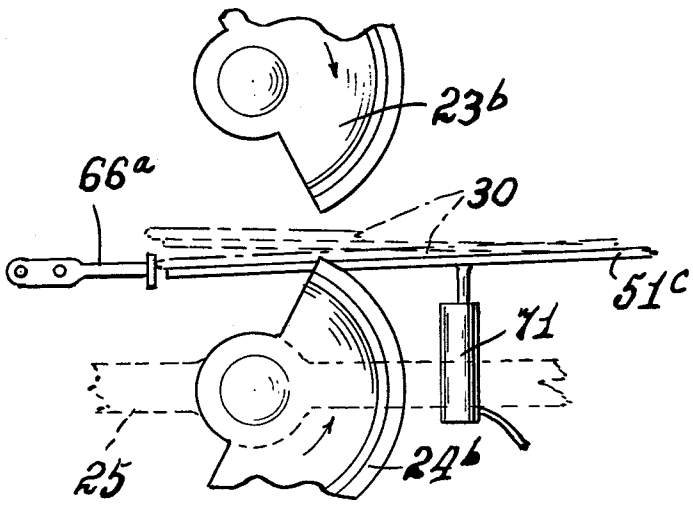
FIG. 12, is a view showing another back-up assembly including movable guide strips.

In the FIG. 12 disclosure, the stop 66*a* is stationary and means in the form of a piston-cylinder assembly 71 is connected to the guide strips 51*c* for moving them from their lowered position shown in full lines into the elevated dotted line position shown. This carries the bag or paperboard thereon upwardly to clear the stop 66*a* whereupon the bag or paperboard can be engaged by and fed between the printing segment 23*b* and back-up segment 24*b*.

It should be understood that the automatic bag lifting means 54–64 may be utilized on the discharge end of the discharge chute 48 shown in the FIG. 1 apparatus.

Operator protection is afforded by a cover 65 (FIG. 1) that is hingedly or otherwise connected to the housing front wall 12. Preferably, this cover is fabricated from suitable transparent plastic so that operation of the apparatus can be observed.

Although I have described preferred embodiments of my invention, in considerable detail, it will be understood that the description thereof is intended to be illustrative, rather than restrictive, as details of the structure may be modified or changed without departing from the spirit or scope of the invention. Accordingly, I do not desire to be restricted to the exact construction shown and described.

I claim:

1. A printing machine for use in printing on an end portion of a bag or an article and the like comprising:

a printing roller having a resilient contacting surface;

a back-up wheel segment having a resilient contacting surface;

means mounting said wheel segment for adjustable movement toward and away from said printing roller;

means for guiding an article to be printed upon between said printing roller and said wheel segment, said guiding means including an elongated stop plate forming a channel positioned beneath of said printing roller and extending in a direction at right angles to the axis of rotation of said printing roller, said stop plate having integral arms for horizontal adjustment toward and away from said printing roller and a guide stop adjustable laterally to position the article to be printed upon;

said guiding means further including inclined guide surfaces disposed on the sides of said wheel segment adjacent said channel to guide the article into the stop plate;

means actuable upon feeding the article toward said wheel segment and said printing roller to carry said wheel segment into contact with the article and the article into contact with the printing roller;

an arm journalling said wheel segment and being pivotally mounted at one end thereof, the other end being connected to said means for carrying said wheel segment into contact with the article, said wheel segment being substantially intermediate of the ends of said arms;

said adjustable means including an adjustable stop arranged above the other end of the arm to limit the upward movement and a fixed stop arranged below the other end of the arm to limit the downward movement; and drive means common to said printing roller and said wheel segment for rotating them in unison, said drive means including an endless drive member operably connected to said printing roller and said back-up wheel segment.

2. A printing machine as claimed in claim 1, further comprising transfer means operably connected to said printing roller for rotation thereof and transferring ink thereto, said drive means being common to said transfer means and said wheel segment.

3. A printing machine as claimed in claim 2, wherein said transfer means comprise an ink transfer roller being in surface contact with said printing roller to transfer ink thereto, a free-rolling ink roller being in surface contact with the transfer roller to transfer ink thereto, and an ink reservoir having a U-shaped bearing in which the ink roller is journalled, said ink reservoir having a screw adjustment to vary contact pressure between the ink roller and the transfer roller.

4. A printing machine as claimed in claim 1, wherein said printing roller comprises a wheel segment.

5. A printing machine as claimed in claim 1, further including means for conveying the printed article from the machine.

6. A printing machine as claimed in claim 5, wherein said conveying means comprise a rotatable shaft having L-shaped brackets and a piston-cylinder assembly having a clamp plate, the clamp plate being movable upwardly towards the bracket to engage the printed article therebetween and subsequently the shaft being rotated to remove the printed article from the machine.

7. A printing machine as claimed in claim 1, further including air actuated piston-cylinder means for operatively carrying the wheel segment which is adapted to move upwardly into contact with the article.

8. The printing machine recited in claim 1, wherein a second set of printing roller and back-up segment is located to received the discharged article for imprinting additional indicia thereon.

* * * * *